US006788002B2

(12) United States Patent
Miyata

(10) Patent No.: US 6,788,002 B2
(45) Date of Patent: Sep. 7, 2004

(54) LED DISPLAY PANEL AND LED DISPLAY APPARATUS

(75) Inventor: Masataka Miyata, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/300,893

(22) Filed: Nov. 21, 2002

(65) Prior Publication Data

US 2003/0122493 A1 Jul. 3, 2003

(30) Foreign Application Priority Data

Dec. 28, 2001 (JP) ..... 2001-400674

(51) Int. Cl.[7] ..... G09G 3/10

(52) U.S. Cl. ..... 315/169.1; 315/169.1; 313/500

(58) Field of Search ..... 315/169.1, 169.2, 315/169.4, 169.3; 313/500, 505, 400; 345/204, 36, 55; G09G 3/10

(56) References Cited

U.S. PATENT DOCUMENTS

2003/0179191 A1 * 9/2003 Matsuda et al. ..... 345/204

FOREIGN PATENT DOCUMENTS

| | | | |
|---|---|---|---|
| JP | 10-49106 A | 2/1998 | ..... G09G/3/32 |
| JP | 2001-109433 A | 4/2001 | ..... G09G/3/32 |
| JP | 2001-125541 A | 5/2001 | ..... G09G/3/32 |

* cited by examiner

*Primary Examiner*—Don Wong
*Assistant Examiner*—Trinh Vo Dinh
(74) *Attorney, Agent, or Firm*—Birch, Stewart, Kolasch & Birch, LLP

(57) ABSTRACT

An LED display panel including a plurality of LEDs arranged in a matrix, a plurality of lighting data lines connecting the LEDs in either one of a row direction and a column direction, and a plurality of scanning lines connecting the LEDs in the other one of the row direction and the column direction. At least either the lighting data lines or the scanning lines connect the LEDs such that the lighting data lines or the scanning lines form groups of at least two lines crossing in a staggered configuration.

7 Claims, 6 Drawing Sheets

LED DISPLAY PANEL AND LED DISPLAY APPARATUS

This nonprovisional application claims priority under 35 U.S.C. § 119(a) on Patent Application No. 2001-400674 filed in JAPAN on Dec. 28, 2001, which is herein incorporated by reference.

CROSS-REFERENCE TO RELATED APPLICATION

This application is related to Japanese Patent Application No. 2001-400674 filed on Dec. 28, 2001, whose priority is claimed under 35 USC §119, the disclosure of which is incorporated by reference in its entirety.

BACKGROUND OF THE INVENTION

1. Field of the Invention

The present invention relates to an LED (light emitting diode) display panel and an LED display apparatus. More particularly, it relates to an LED display panel and an LED display apparatus which are suitable for conveying information such as used for a traffic information bulletin board.

2. Description of Related Art

LED display apparatus using LED display panels are employed for traffic information bulletin boards and the like. An LED display panel is constructed to include a plurality of LEDs arranged in columns and rows to form a so-called dot matrix and is adapted to display characters, figures and others by activation of some of the LEDs using a dynamic drive circuit composed of transistors, for example.

A dynamically driven LED display apparatus known conventionally is described with reference to FIG. 7 and FIG. 8.

As shown in FIG. 8, in the display panel having LEDs regularly arranged in columns and rows in the matrix (e.g., n rows×n columns), the LEDs ($L_{11}$, $L_{12}$, . . . , $L_{1n}$, $L_{21}$, $L_{22}$, . . . , $L_{n1}$, $L_{n2}$, . . . , $L_{nn}$) are connected in a matrix in such a manner that they are located between column lines (referred to as X lines 52, each line being indicated as $X_1$, $X_2$, . . . , $X_n$) and row lines (referred to as Y lines 54, each being indicated as $Y_1$, $Y_2$, . . . , $Y_n$). More particularly, n LEDs $L_{11}$, $L_{12}$, . . . , $L_{1n}$ are connected sequentially from line X1 to line Xn along line $Y_1$, n LEDs $L_{21}$, $L_{22}$, . . . , $L_{2n}$ are connected along line $Y_2$, and n LEDs $L_{n1}$, $L_{n2}$, $L_{nn}$ are connected along line $Y_n$.

Either the X lines 52 or the Y lines 54 are connected to output terminals of a lighting data drive circuit for transmitting lighting data, and the lighting data is transmitted to each LED from the lighting data drive circuit. The other lines are connected to output terminals of a scanning drive circuit and are sequentially scanned line by line.

FIG. 7 is a block diagram illustrating the construction of driving circuits for driving the LED display apparatus shown in FIG. 8. In FIG. 7, column lines (X lines 52) are lighting data input lines, and row lines (Y lines 54) are scanning lines (also referred to as common lines). In the figure, LEDs ($L_{11}$ to $L_{nn}$) are arranged in a matrix on a display panel 60, LEDs in the respective columns are linearly connected by lines $X_1$ to $X_n$ corresponding to the columns, and LEDs in the respective rows are linearly connected by lines $Y_1$ to $Y_n$ corresponding to the rows.

The lines X1 to Xn are connected to output terminals $a_1$, $a_2$, . . . , $a_n$ of a lighting data drive circuit (X line drive circuit) 62. Lighting data about characters and the like to be displayed on the display panel is input to the lighting data drive circuit 62. The lighting data drive circuit 62 includes a shift register, a latch and a luminance adjusting circuit. The lighting data transmitted via a signal line is input to the shift register in timing with a clock pulse (not shown). The data of each of the lines $X_1$ to $X_n$ (data for one scanning line) is latched for a predetermined time, and shifted in the next timing. New lighting data (data for the next one scanning line) is sequentially input to the shift register. Thus lighting data necessary for forming one picture is stored in the shift register.

On the other hand, the lines $Y_1$ to $Y_n$ are connected to output terminals of a scanning drive circuit (Y line drive circuit) 64 whose input side is connected to a decoder 66.

Address signals are input to the decoder 66 from address line $A_0$, $A_1$, $A_2$, $A_3$. Address signal values transmitted from the address lines are set to increment. When the address signal values are input to the decoder 66, the output from the decoder 66 is input to the scanning drive circuit 64 to turn the line $Y_1$ on first. When a predetermined time has elapsed by count of a clock pulse (not shown), the line $Y_1$ is turned off and the line $Y_2$ is turned on. This operation is repeated until the line $Y_n$ is turned on, and then the line $Y_1$ is turned on again. This process is repeated in the same manner. Thereby the row lines (Y lines) are scanned.

Therefore, by synchronizing the timing of data shift by the lighting data drive circuit (X line drive circuit) 62 and the timing of scanning by the scanning drive circuit (Y line drive circuit) 64, the entire one picture can be displayed. Two hundred fifty times of scanning per second realize the display of the picture without flickers.

In the LED display apparatus of the dynamic drive system as described above, if one of the scanning lines (common lines), for example, the line $Y_1$, is out of order, all LEDs in one row connected to the line $Y_1$ do not illuminate.

LED display apparatus for traffic information bulletin boards are often used continuously under any weather condition day and night, and with such apparatus, failures cannot be avoided completely.

For this reason, even if a failure occurs, what should be avoided most is that the failure makes the contents of information displayed on the apparatus unable to be understood at all.

SUMMARY OF THE INVENTION

Accordingly, an object of the present invention is to provide an LED display panel and an LED display apparatus which are adapted to allow reasoning by analogy the contents of displayed information such as characters or the like from dots (LEDs) capable of lighting even if a drive circuit or a line of the LED display panel fails and non-lighting dots (LEDs which are in a non-lighting state) result from the failure.

Also an object of the present invention is to provide an LED display panel and an LED display apparatus which can report a failure to urge the shooting of the failure if a drive circuit, a line or the like thereof is out of order.

The LED display panel (a) of the present invention is characterized by comprising a plurality of LEDs arranged in a matrix, a plurality of lighting data lines connecting the LEDs in either one of a row direction and a column direction, and a plurality of scanning lines connecting the LEDs in the other one of the row direction and the column direction, at least either the lighting data lines or the scanning lines connecting the LEDs such that the lighting data lines or the scanning lines form groups of at least two lines crossing in a staggered configuration.

The LED display apparatus of the present invention is characterized by comprising (a) the LED display panel as described above, (b) a lighting data drive circuit having a plurality of lighting data output terminals for transmitting lighting data to the lighting data lines of the LED display panel which are connected to the lighting data output terminals, and (c) a scanning drive circuit having a plurality of scanning output terminals for sequentially scanning the scanning lines of the LED display panel which are connected to the scanning output terminals.

According to the present invention with the above-mentioned construction, since the LEDs are so arranged that either the lighting data lines or the scanning lines connect the LEDs in such a manner that the lighting data lines or the scanning lines form the groups of at least two lines in the staggered configuration, all LEDs on one column or row cannot fall wholly in the non-lighting state even if a failure occurs.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
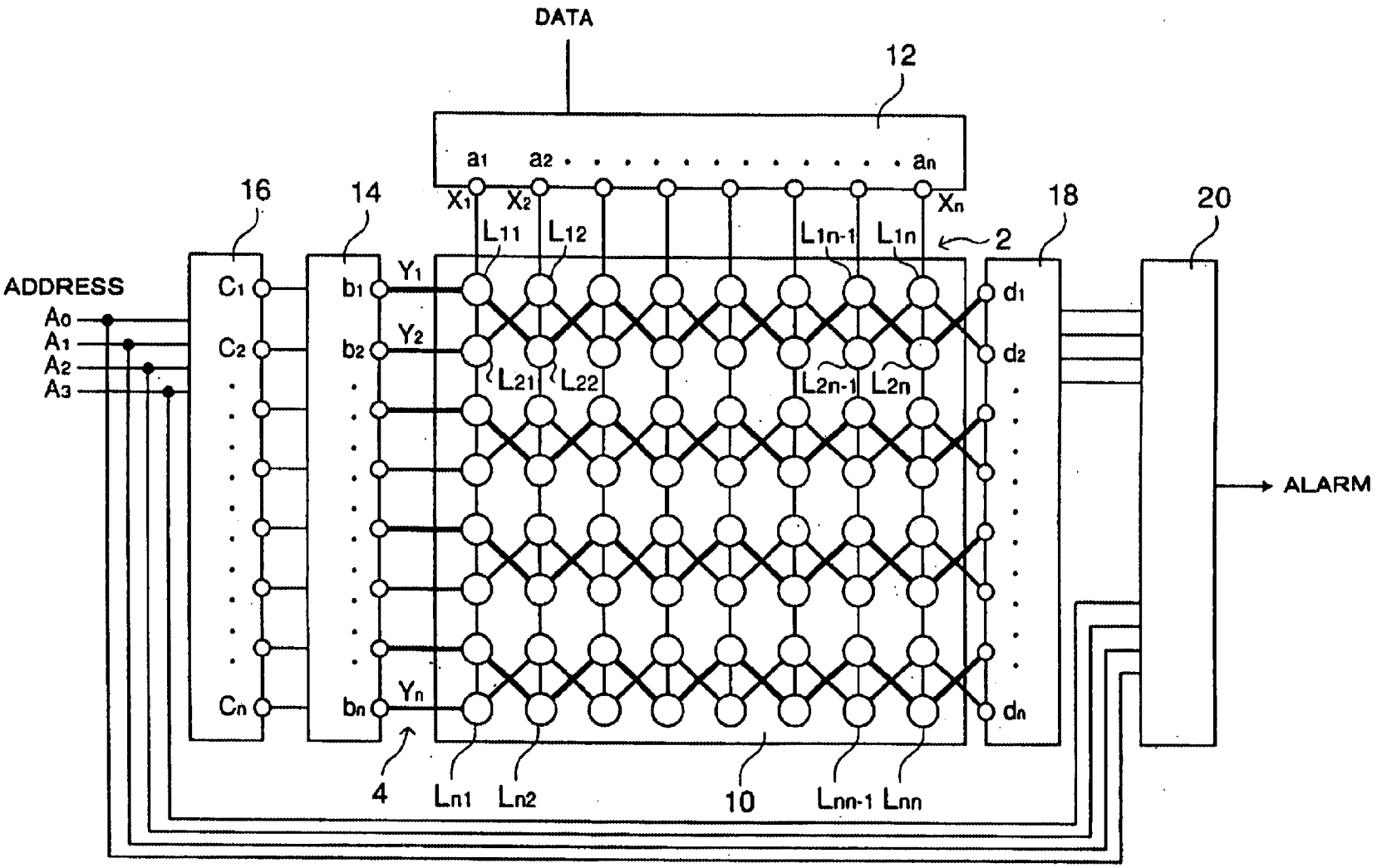
FIG. 1 is a block diagram illustrating the construction of an LED display apparatus in accordance with an example of the present invention.

Now detailed description is given of the LED display apparatus using the LED display panel of the present invention. The LED display apparatus includes:

(a) an LED display panel having a plurality of LEDs arranged in a matrix, a plurality of lighting data lines connecting the LEDs in either one of a row direction and a column direction, and a plurality of scanning lines connecting the LEDs in the other one of the row direction and the column direction, wherein at least either the lighting data lines or the scanning lines connect the LEDs such that the lighting data lines or the scanning lines form groups of at least two lines crossing in a staggered configuration;

(b) a lighting data drive circuit having a plurality of lighting data output terminals for transmitting lighting data to the lighting data lines of the LED display panel which are connected to the lighting data output terminals; and (c) a scanning drive circuit having a plurality of scanning output terminals for sequentially scanning the scanning lines of the LED display panel which are connected to the scanning output terminals.

A first specific example for explaining the details of the above-describing LED display apparatus of the present invention is provided with (a) a display panel including a plurality of LEDs arranged in a matrix, and a plurality of lighting data lines and a plurality of scanning lines for driving the LEDs, the lighting data lines connecting the LEDs linearly in either the row direction or the column direction and the scanning lines connecting the LEDs in the other one of the row direction or the column direction that is different from the direction of the lighting data lines in such a manner that the scanning lines form groups of at least two scanning lines crossing each other in the staggered configuration; (b) a lighting data drive circuit having a plurality of lighting data lines for transmitting the lighting data to the lighting data lines connected to the lighting data output terminals; and (c) a scanning drive circuit having a plurality of scanning output terminals for sequentially scanning the scanning lines connected to the scanning output terminals.

According to this invention, the LEDs are arranged in the matrix on the display panel. The LEDs are connected to be located between the lighting data lines and the scanning lines.

The lighting data lines connect the LEDs linearly in either the row direction or the column direction in the matrix. The scanning lines connect the LEDs in the row direction or the column direction that is different from the direction of the lighting data lines in the manner that the scanning lines are divided into stagger connection groups of at least two scanning lines crossing each other in the staggered configuration.

The lighting data drive circuit has the lighting data output terminals, which are connected to the lighting data lines one by one. When the lighting data drive circuit is driven, lighting data is transmitted to the lighting data lines connected to the lighting data output terminals.

Since each lighting data line is connected to LEDs aligned linearly, the lighting data of each line is transmitted to the linearly aligned LEDs.

On the other hand, the scanning drive circuit has the scanning output terminals, which are connected to the scanning lines one by one. When the scanning drive circuit is driven, the scanning lines connected to the scanning output terminals are sequentially scanned.

The scanning lines do not connect the LEDs linearly, but connect the LEDs in the staggered configuration. More particularly, the scanning lines form stagger connection groups of at least two scanning lines.

Information is displayed on the LED display apparatus by driving the lighting data lines and the scanning lines in synchronization. That is, with regard to the lighting data lines, at a certain timing, an on-signal is transmitted to lighting data lines connected to LEDs to be lighted, and an off-signal is transmitted to lighting data lines connected to LEDs not to be lighted (more particularly, the lighting data lines to the LEDs to be on become in a conductible state and the lighting data lines to the LEDs to be off become in an open state). On the other hand, the scanning lines are scanned so that they become sequentially in a conductible state in synchronization with the timing of the on- and off-signals to the lighting data lines.

Thereby, the LEDs on the entire screen can be lighted to display a desired character or the like according to the lighting data.

Here, even if any one of the scanning lines fails, not all the LEDs in a row or a column corresponding to the failed scanning line fall in the non-lighting state due to the failure, because the scanning lines connect the LEDs in the staggered configuration wherein the scanning lines are divided into the stagger connection groups of at least two scanning lines which cross each other. That is, some of the LEDs in the corresponding line or column are connected to a scanning line that forms the stagger connection group together with the failed scanning line, and therefore, emit light. A viewer of a displayed image at this time will assume that the line is partially in the non-lighting state because of a failure and recognize the character or the like by analogizing that the line should properly be all lit.

As a second example of this invention, the scanning lines may connect the LEDs linearly, and the lighting data lines may connect the LEDs in such a manner that the lighting data lines form groups of at least two lighting data lines crossing in a staggered configuration. Further, as a third example of the above-described invention, the lighting data lines may connect the LEDs in such a manner that the lighting data lines form groups of at least two lighting data lines crossing in a staggered configuration, and also the scanning lines may connect the LEDs in such a manner that the scanning lines form groups of at least two scanning lines crossing in a staggered configuration.

In both the second and third examples, the LEDs connected to a lighting data or scanning line that forms a stagger connection group together with a failed lighting data line or scanning line emit light, and thereby the same effect as achieved by the first example can be obtained.

The staggered configuration may be formed of two lines or of three or more lines.

Next, another example of the LED display apparatus of the present invention is explained. This LED display apparatus may include:

(a) an LED display panel having LEDs of two or more colors arranged in a matrix for each color, a plurality of scanning lines connecting the LEDs of all colors commonly, and a plurality of lighting data lines connecting the LEDs of each color separately, the scanning lines connecting the LEDs in either one of a row direction and a column direction such that the scanning lines form groups of at least two lines crossing in a staggered configuration and the lighting data lines connecting the LEDs of the same color linearly in the other one of the row direction and the column direction;

(b) a plurality of lighting data drive circuits provided separately for each color, each having a plurality of lighting data output terminals for transmitting lighting data to the lighting data lines connected to the lighting data output terminals; and (c) a scanning drive circuit having a plurality of scanning output terminals for sequentially scanning the scanning lines connected to the scanning output terminals.

In the LED display apparatus of the present invention, ends of the scanning lines are connected to the scanning output terminals of the scanning drive circuit and other ends of the scanning lines are connected to a detection circuit for detecting whether or not scanning is normally performed, the LEDs being sandwiched between said ends and the said other ends of the scanning lines.

The LED display apparatus of the present invention may include:

a display panel having a plurality of LEDs arranged in a matrix, and a plurality of lighting data lines and scanning lines for driving the LEDs, the lighting data lines connecting the LEDs linearly in either one of a row direction and a column direction, and the scanning lines connecting the LEDs in the other one of the row direction and the column direction such that the scanning lines form groups of at least two lines crossing in a staggered configuration;

a lighting data drive circuit having the same number of lighting data output terminals as the lighting data lines for transmitting lighting data to the lighting data lines connected to the lighting data output terminals;

a scanning drive circuit having the same number of scanning output terminals as the scanning lines for sequentially scanning the scanning lines connected to the scanning output terminals;

a decoder which receives address data about a scanning sequence and transmits to the scanning drive circuit a signal for sequentially scanning the scanning output terminals of the scanning drive circuit according to the received address data;

an encoder to which the scanning lines are connected; and a comparator for comparing the address data input to the decoder with output data from the encoder.

With this construction, data output from the encoder passes through the decoder and the encoder and is restored to the original data input to the decoder. If both the data from the encoder and the data to the decoder are judged as being the same from comparison by the comparator, scanning can be judged as having been done normally. If not, it is recognized that an abnormality such as the breaking-down of a wire takes place in one/some of the lines. Thus the presence of a failure can be detected from the output from the comparator.

The present invention is now explained with reference to the attached drawings. FIG. 1 is a block diagram illustrating the construction of an LED display apparatus in accordance with an example of the present invention.

This LED display apparatus is constructed of a display panel 10, a lighting data drive circuit (X line drive circuit) 12, a scanning drive circuit (Y line drive circuit) 14, a decoder 16, an encoder 18, and a comparator 20.

On the display panel 10, LEDs are arranged regularly in a matrix (e.g., n rows×n columns).

In the matrix, LEDs $L_{11}, L_{12}, \ldots, L_{1n}$ are arranged on the first row sequentially from the left, LEDs $L_{21}, L_{22}, \ldots, L_{2n}$ are arranged on the second row sequentially from the left, and LEDs $L_{n1}, L_{n2}, \ldots, L_{nn}$ are arranged on the bottom n-th row sequentially from the left.

The LEDs on the display panel 10 are connected to lighting data lines 2 for sending lighting data and scanning lines 4 for scanning.

The lighting data line 2 is connected to LEDs linearly in a column direction. Since the display panel 10 has n LED arrays, n lighting data lines $X_1, X_2, \ldots, X_n$ are arranged in parallel. To the line $X_1$ at the leftmost column in the figure, LEDs $L_{11}, L_{21}, \ldots, L_{n1}$ are connected. LEDs $L_{12}, L_{22}, \ldots, L_{n2}$ are connected to the second line $X_2$ from the left, and LEDs $L_{1n}, L_{2n}, \ldots, L_{nn}$ are connected to the line $X_n$ at the rightmost column.

On the other hand, the scanning lines 4 are connected to the LEDs in such a manner that the scanning lines 4 cross each other in a staggered configuration in the row direction.

More particularly, as shown in the figure, two scanning lines $Y_1$, $Y_2$ make a group, the line $Y_1$ being connected to LEDs $L_{11}$, $L_{22}$, $L_{13}$, $L_{24}$, . . . , $L_{2n}$ and the line $Y_2$ being connected to LEDs $L_{21}$, $L_{12}$, $L_{23}$, $L_{14}$, . . . , $L_{1n}$. Similarly, the lines $Y_3$ to $Y_n$ are connected to LEDs in such a manner that two lines cross each other in the staggered configuration.

The lines form groups of two lines in the staggered configuration in this example. However, three or more lines may form a group in the staggered configuration.

The lighting data drive circuit (X line drive circuit) 12 is a drive circuit for transmitting to the lines $X_1$ to $X_n$ the lighting data regarding characters or the like to be displayed on the display panel.

The lighting data drive circuit 12 is provided with the same number of output terminals as the number of the lighting data lines of the display panel 10 to which the lighting data drive circuit 12 is connected. In this example, since the display panel 10 has n lighting data lines, n output terminals $a_1$, $a_2$, . . . , $a_n$ are formed in the lighting data drive circuit 12. The lighting data transmitted via a data line is input to the lighting data drive circuit 12.

The lighting data circuit 12 includes a shift register, a latch, and a luminance adjusting circuit. The lighting data transmitted via the data line is transmitted to the shift register in timing with a clock pulse (not shown). The lighting data for the lines $X_1$ to $X_n$ (lighting data for one scanning line) is latched for a predetermined time and is shifted at the next timing, when new lighting data (lighting data for the next one scanning line) is taken in. This operation is repeated similarly.

The scanning drive circuit (Y line drive circuit) 14 is a drive circuit for sequentially scanning the scanning lines $Y_1$ to $Y_n$ of the display panel 10.

The scanning drive circuit 14 is provided with the same number of output terminals as the number of the scanning lines of the display panel 10 to which the scanning drive circuit 14 is connected. In this example, since the display panel 10 has n scanning lines, n output terminals $b_1$, $b_2$, . . . , $b_n$ are formed in the scanning drive circuit (Y line drive circuit) 14.

The scanning lines $Y_1$ to $Y_n$ of the display panel 10 are connected to the output terminals $b_1$ to $b_n$ of the scanning drive circuit 14 one by one. In this example, the line $Y_1$ is connected to $b_1$, the line $Y_2$ to $b_2$, . . . , and the line $Y_n$ to $b_n$.

The scanning drive circuit 14 receives signals for controlling the scanning lines sequentially from the decoder 16.

The decoder 16 is provided with output terminals $c_1$, $c_2$, . . . , $c_n$ corresponding to the output terminals $b_1$, $b_2$, . . . , $b_n$ of the scanning drive circuit 14. The decoder 16 receives address data from address lines $A_0$, $A_1$, $A_2$, $A_3$ and transmits control signals to the scanning drive circuit 14 so that the output terminals $b_1$, $b_2$, . . . , $b_n$ are sequentially scanned. The address data transmitted from the address lines to the decoder 16 is incremented. When the address data is input to the decoder 16, the output terminals $c_1$, $c_2$, . . . , $c_n$ of the decoder 16 are turned on sequentially in this order, and an on-signal is input to the scanning drive circuit 14 to turn the line $Y_1$ on first. After a predetermined time counted by the clock pulse (not shown) has elapsed, the line $Y_1$ is turned off and the line $Y_2$ is turned on instead. The same operation is repeated, and thereby, the scanning lines (Y lines) are scanned sequentially.

Accordingly, an image is displayed on the whole screen by driving the lighting data drive circuit (X line drive circuit) 12 and the scanning drive circuit (Y line drive circuit) 14 with synchronizing the timing of data shifting by the lighting data drive circuit 12 with the timing of scanning by the scanning drive circuit 14. The scanning is repeated about 250 times per second, thereby performing flicker-free display.

An encoder 18 is connected to the scanning lines. In this example, the encoder 18 is connected to ends of the scanning lines on a rightmost LED array ($L_{1n}$, $L_{2n}$, $L_{3n}$, $L_{4n}$, . . . , $L_{nn}$) side (i.e., a side opposite to where the scanning drive circuit 14 is connected).

The encoder 18 is provided with the same number of input terminals $d_1$, $d_2$, . . . , $d_n$ as the number of the output terminals $c_1$, $c_2$, . . . , $c_n$ of the decoder 16. The ends of the scanning lines are connected to the encoder 18 so that an input signal is input to the terminal $d_1$ of the encoder 18 when the terminal $c_1$ of the decoder 16 is turned on, an input signal is input to $d_2$ when $c_2$ is turned on and an input signal is input to $d_n$ when $c_n$ is turned on. Thereby the output data of the encoder 18 will be the same as the input data of the decoder 16.

A comparator 20 is connected in such a manner that the output data of the encoder 18 and the address signal value which is the input data of the decoder 16 are input in parallel to the comparator 20 for comparison of both the data. The output of the comparator 20 is connected to a known alarm mechanism or the like (not shown) for notifying an abnormal condition.

Next, display states of the above-described display apparatus are explained.

Figure 3:
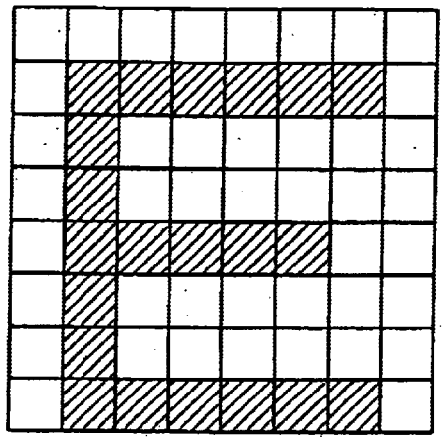
FIG. 3 illustrates a normal display state of an LED display apparatus.
Figure 4:
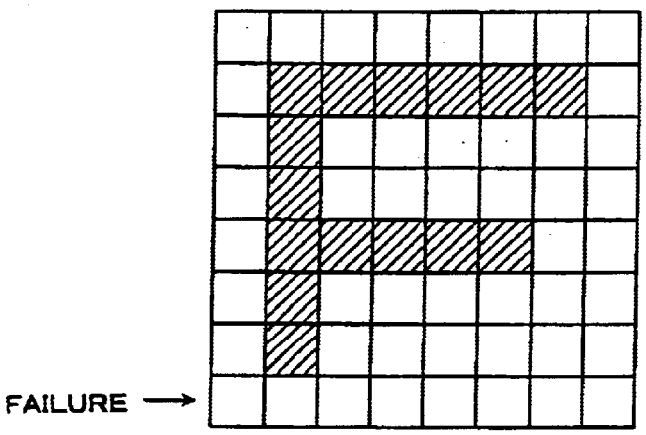
FIG. 4 illustrates a display state when a prior-art LED display apparatus is out of order.
Figure 5:
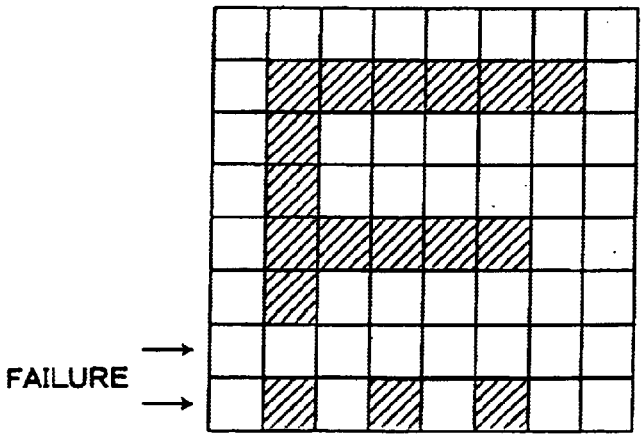
FIG. 5 illustrates a display state when the LED display apparatus shown in FIG. 1 is out of order.
Figure 7:
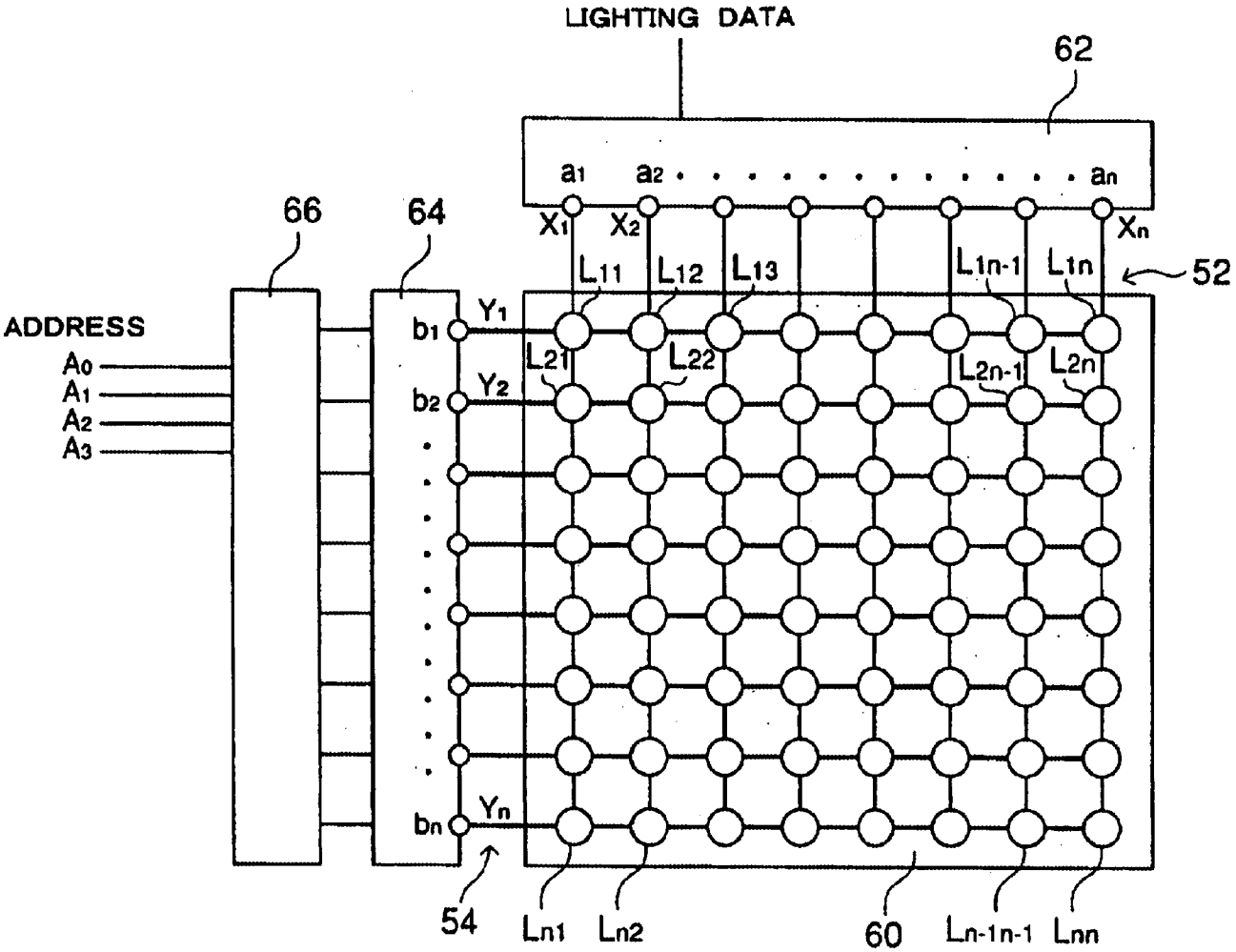
FIG. 7 is a block diagram illustrating the construction of a prior-art LED display apparatus.
Figure 8:
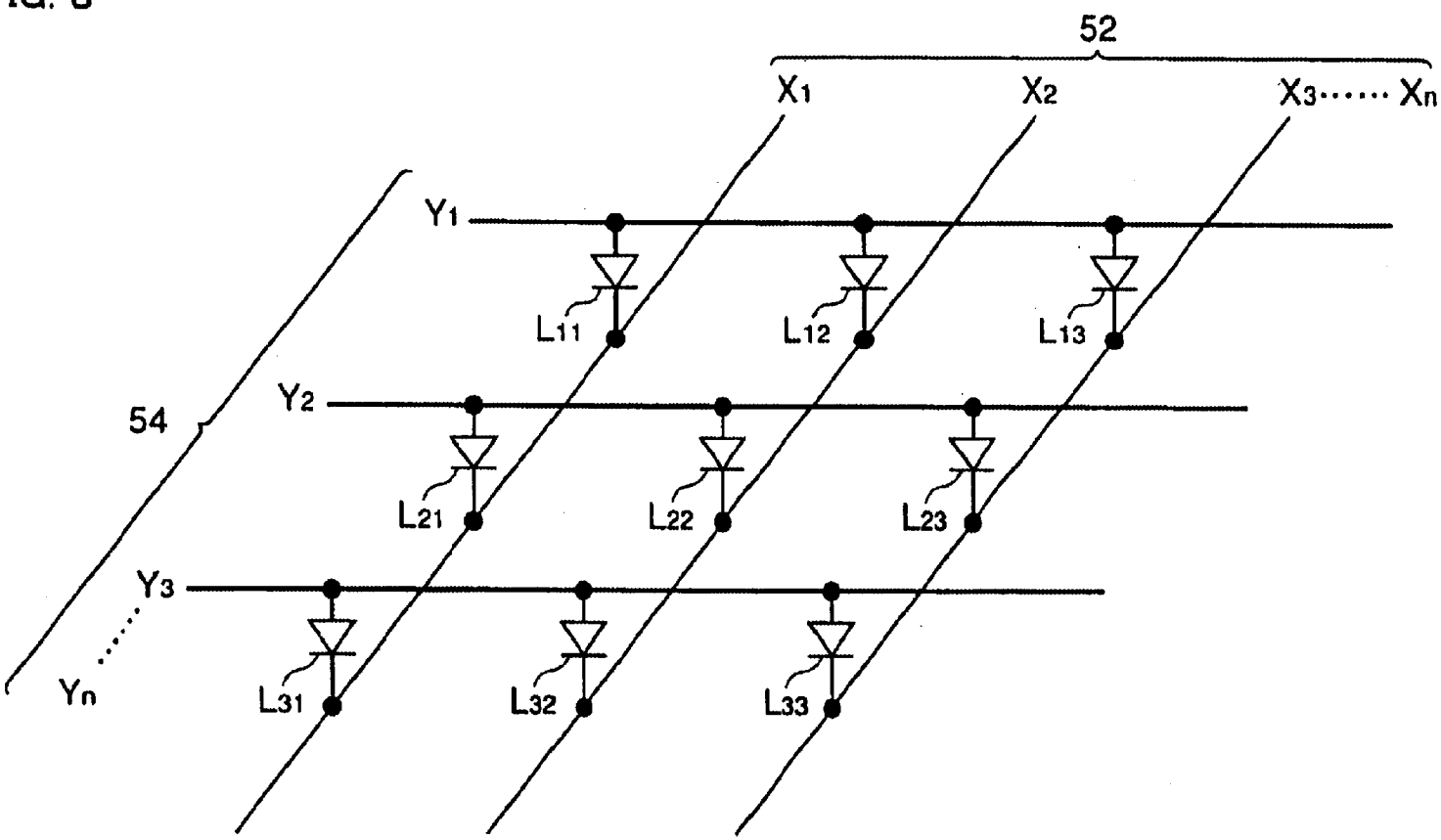
FIG. 8 illustrates a matrix of LEDs of an LED display apparatus.

FIGS. 3 to 5 illustrate display states of LED display apparatus, FIG. 3 showing a normal display state, FIG. 4 showing a comparative display state when a scanning line is out of order in the prior-art LED display apparatus shown in FIG. 7, and FIG. 5 showing a display state when a scanning line is out of order in the LED display apparatus shown in FIG. 1. Here, the LED display apparatus have n=8, that is, eight rows×eight columns, for example.

Taking for example a case where an alphabetical character "E" is displayed. As shown in FIG. 3, the character "E" is distinctly displayed when the lighting data lines and the scanning lines are all normal.

Suppose that a line $Y_8$ is out of order in the LED display apparatus of FIG. 1 and FIG. 7.

In the LED display apparatus of FIG. 7, since the line $Y_8$, which is one of the scanning lines, connects LEDs linearly in the row direction, all the LEDs on the bottom row (the eighth row) do not emit light as shown in FIG. 4. Most characters including "E" are composed of vertical and lateral linear elements. Accordingly, if a linear element of a character to be displayed happens to be along a scanning line out of order, the shape of the character changes radically due to the lack of the linear element and consequently the character cannot be recognized. In FIG. 4, as a result from the bottom lateral line of "E" not lighting owing to the failure of the bottom scanning line, the displayed character may be mistakenly read as "F".

In contrast, in the LED display apparatus of FIG. 1, since the line $Y_8$ and a line $Y_7$ thereon are connected to LEDs in the staggered configuration, half the LEDs on the bottom row are connected to the line $Y_7$. Accordingly, every other LED on the bottom row emits light as shown in FIG. 5. Therefore, the character displayed by the lighting LEDs can be recognized by analog as "E" but not "F."

In this case, every other LED is not capable of lighting also in the second bottom row. Consequently, in the case where a character to be displayed has a lateral line in the second bottom row, non-lighting portions occur in the lateral line. However, also in this case, since the LEDs in the second bottom row partially emit light, the displayed character can be recognized by analog, and thus the contents of information can be realized.

Furthermore, in the event of failure of the line $Y_8$, the scanning signal is not transmitted to the terminal $d_8$ of the encoder 18 connected to the line $Y_8$. The comparator 20 compares the output data from the encoder 18 with the input data of the decoder 16 and detects a difference therebetween.

The comparator 20 can transmit an output signal to the alarm mechanism or the like (not shown), which will then notify that the display is in an abnormal condition.

Figure 2:
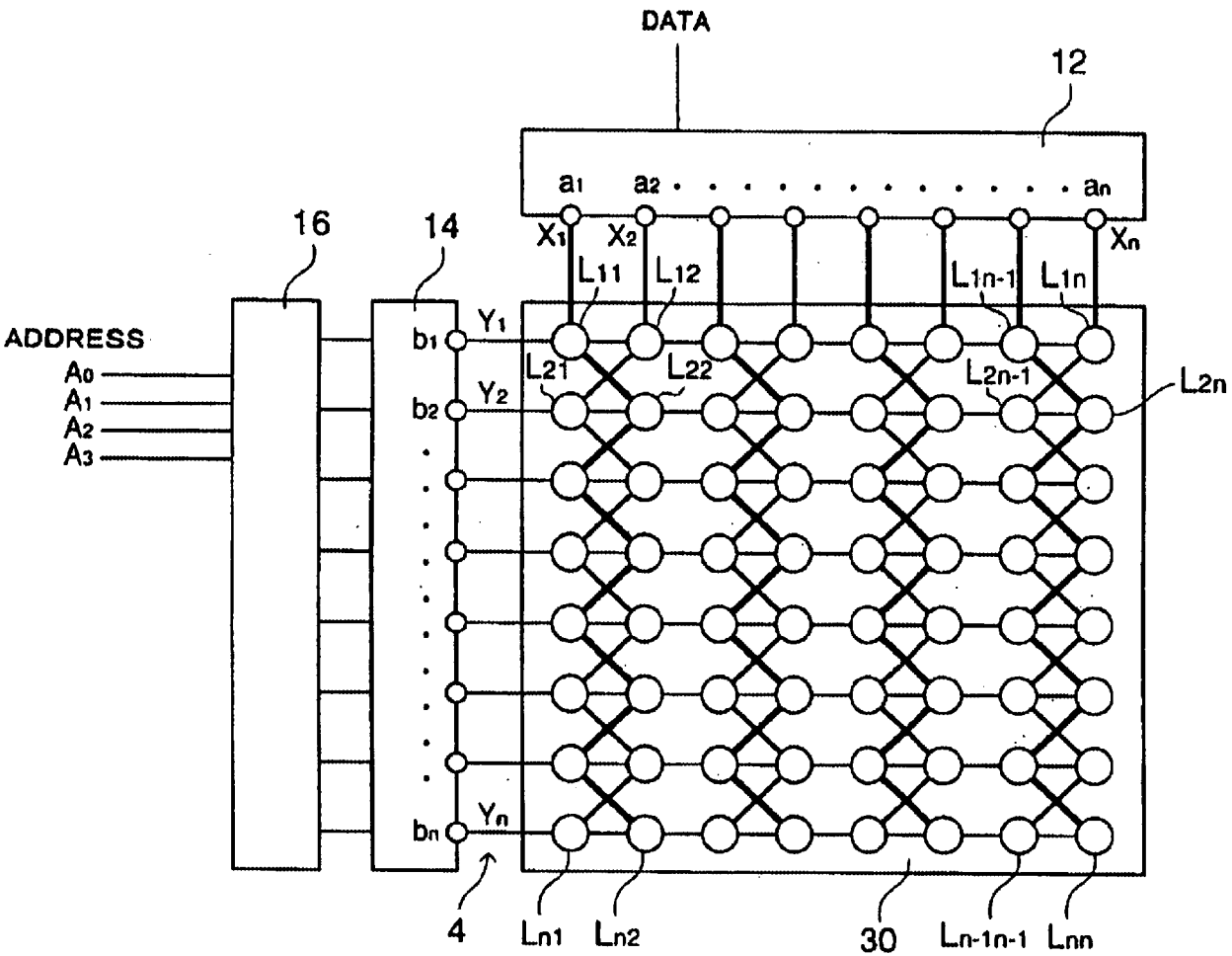
FIG. 2 is a block diagram illustrating the construction of an LED display apparatus in accordance with an example of the present invention.

FIG. 2 is a block diagram illustrating the construction of an LED display apparatus in accordance with another example of the present invention.

In the figure, the same symbols denote the same elements as in FIG. 1, and thus the explanation thereof is omitted.

A display panel 30 of this example is adapted so that, reversely to that of FIG. 1, scanning lines $Y_1, Y_2, \ldots, Y_n$ of a scanning drive circuit 14 are linearly connected to LEDs and lighting data lines $X_1, X_2, \ldots, X_n$ are connected to LEDs in the staggered configuration.

In this case, even if one of the lighting data lines is out of order, all the LEDs in one column (vertical line) being incapable of lighting can be avoided. Similar effect to that of the display panel of FIG. 1 can be expected.

It is needless to say that the scanning lines and the lighting data lines are both arranged in the staggered configuration so that the above-mentioned effect can be obtained in both the vertical and lateral lines.

In the above-described examples, the lighting data is transmitted in the column direction and the scanning is performed in the row direction. However, the scanning may be performed in the column direction and the lighting data may be transmitted in the row direction.

In the above-described examples, the color of the LEDs is not specifically considered, and all the LEDs are supposed to be of the same color. However, the present invention is also applicable to an LED display apparatus using LEDs of two or more colors.

Figure 6:
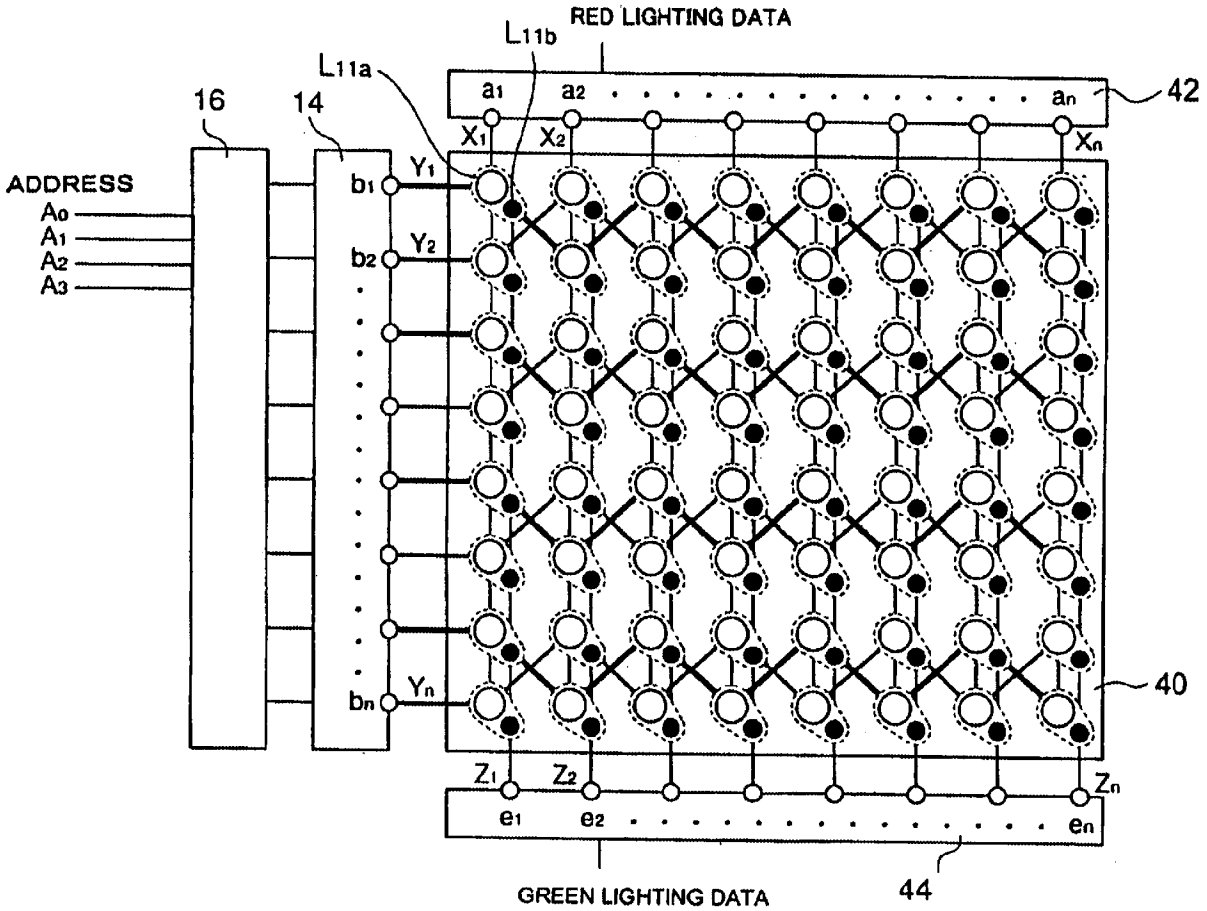
FIG. 6 is a block diagram illustrating the construction of an LED display apparatus in accordance with an example of the present invention.

FIG. 6 is a block diagram illustrating the construction of drive circuits of an LED display apparatus using LEDs of two colors, red and green. In the figure, the same symbols denote the same elements as in FIG. 1, and thus the explanation thereof is omitted.

In an LED display panel 40 capable of displaying two colors, red and green, red LEDs $L_{11a}$ to $L_{nna}$ and green LEDs $L_{11b}$ to $L_{nnb}$ are arranged in a matrix. More particularly, in the construction shown in FIG. 1, $L_{11}$ is replaced with $L_{11a}$ and $L_{11b}$, and the other LEDs $L_{12}$ to $L_{11}$ are replaced in the same manner.

Since the red LEDs and the green LEDs are required to be provided with the lighting data separately, a lighting data drive circuit 42 for red color and a lighting data drive circuit 44 for green color are separately provided. Red lighting data is given to the red LEDs $L_{11a}$ to $L_{nna}$ from the red lighting data drive circuit 42 by lines $X_1$ to $X_n$. Similarly green lighting data is given to the green LEDs $L_{11b}$ to $L_{nnb}$ from the green lighting data drive circuit 44 by lines $Z_1$ to $Z_n$.

A scanning drive circuit 14 is commonly used for the red LEDs and the green LEDs for avoiding the increase of the number of circuits and wirings. Thereby, the increase of the number of components and the production costs can be suppressed. Also the size of the apparatus can be reduced.

As described above, according to the present invention, the scanning lines or the lighting data lines of the display panel are connected to the LEDs so that the lines are grouped into the staggered connection groups of at least two lines. Thereby, if a failure occurs, some of the LEDs in one column or row can avoid the non-lighting state, and the displayed character or the like can be recognized by analogy from the lighting LEDs. Thus the information on the display panel can be conveyed to viewers.

Also by providing the circuit for detecting a failure and sending out a failure signal, the occurrence of the failure can be easily realized.

What is claimed is:

1. An LED display panel comprising:

a plurality of LEDs arranged in a matrix;

a plurality of lighting data lines connecting the LEDs in either one of a row direction and a column direction; and a plurality of scanning lines connecting the LEDs in the other one of the row direction and the column direction, wherein at least either the lighting data lines or the scanning lines connect the LEDs such that the lighting data lines or the scanning lines form groups of at least two lighting data lines or at least two scanning lines crossing in a staggered configuration.

2. The LED display apparatus comprising:

an LED display panel as set forth in claim 1;

a lighting data drive circuit having a plurality of lighting data output terminals for transmitting lighting data to the lighting data lines of the LED display panel which are connected to the lighting data output terminals; and a scanning drive circuit having a plurality of scanning output terminals for sequentially scanning the scanning lines of the LED display panel which are connected to the scanning output terminals.

3. The LED display panel according to claim 1, wherein the LEDs comprise LEDs of two or more colors, the LEDs of each color being arranged in a matrix; the lighting data lines connect the LEDs of each color separately and linearly; and the scanning lines connect the LEDs of all colors commonly such that the scanning lines form groups of at least two lines crossing in a staggered configuration.

4. The LED display apparatus comprising:

an LED display panel as set forth in claim 3;

lighting data drive circuits provided separately for each color, each having a plurality of lighting data output terminals for transmitting lighting data to the lighting data lines of the LED display panel which are connected to the lighting data output terminals; and a scanning drive circuit having a plurality of scanning output terminals for sequentially scanning the scanning lines of the LED display panel which are connected to the scanning output terminals.

5. The LED display apparatus according to claim 2 or 4, wherein ends of the scanning lines are connected to the scanning output terminals of the scanning drive circuit and other ends of the scanning lines are connected to a detection circuit for detecting whether or not scanning is normally performed, the LEDs being sandwiched between said ends and the said other ends of the scanning lines.

6. The LED display panel as set forth in claim 1, wherein said panel being for a traffic information bulletin board.

7. The LED display apparatus comprising:

a display panel having a plurality of LEDs arranged in a matrix and a plurality of lighting data lines and scanning lines for driving the LEDs, the lighting data lines connecting the LEDs linearly in either one of a row direction and a column direction, and the scanning lines connecting the LEDs in the other one of the row direction and the column direction such that the lighting data lines or the scanning lines form groups of at least two lighting data lines or scanning lines crossing in a staggered configuration;

a lighting data drive circuit having a plurality of lighting data output terminals for transmitting lighting data to the lighting data lines of the LED display panel which are connected to the lighting data output terminals;

a scanning drive circuit having a plurality of scanning output terminals for sequentially scanning the scanning lines of the LED display panel which are connected to the scanning output terminals;

a decoder which receives address data about a scanning sequence and transmits to the scanning drive circuit a signal for sequentially scanning the scanning output terminals of the scanning drive circuit according to the received address data;

an encoder to which the scanning lines are connected; and a comparator for comparing the address data input to the decoder with output data from the encoder.

* * * * *